US006089064A

United States Patent [19]

Tauzer

[11] Patent Number: 6,089,064

[45] Date of Patent: Jul. 18, 2000

[54] SLIDING PLUG FOR APPLYING END LOADS DURING ISOSTATIC BULGE FORMING

[76] Inventor: Paul J. Tauzer, The Boeing Co., P.O. Box 3707, M/S 13-08, Seattle, Wash. 98124-2207

[21] Appl. No.: 09/260,744

[22] Filed: Feb. 26, 1999

Related U.S. Application Data

[60] Provisional application No. 60/079,660, Mar. 27, 1998.

[51] Int. Cl.[7] ..... B21D 26/02

[52] U.S. Cl. ..... 72/62; 72/56; 29/421.1

[58] Field of Search ..... 72/54, 56, 60, 72/61, 62; 29/421.1

[56] References Cited

U.S. PATENT DOCUMENTS

| | | | |
|---|---|---|---|
| 3,564,886 | 2/1971 | Nakamura | 72/57 |
| 4,384,840 | 5/1983 | Desplanches et al. . | |
| 4,449,281 | 5/1984 | Yoshida et al. . | |
| 4,590,655 | 5/1986 | Javorik . | |
| 4,840,053 | 6/1989 | Nakamura . | |
| 4,875,270 | 10/1989 | Krips et al. . | |
| 5,419,171 | 5/1995 | Bumgarner . | |
| 5,435,163 | 7/1995 | Schäfer . | |
| 5,485,737 | 1/1996 | Dickerson . | |

*Primary Examiner*—David Jones
*Attorney, Agent, or Firm*—John C. Hammar

[57] ABSTRACT

Sliding plugs use o-ring seals against the internal walls of an isostatic bulge forming die to apply end load to tube stock blanks during isostatic bulge forming. The die is made from two or more mating segments that assemble together to define a central channel for holding the tube stock blank. The plugs move inwardly into the die when the blank elongates or expands into the die, because such expansion reduces the internal pressure within the blank. The plugs are drawn inwardly because of the pressure decline in the blank. The plugs compress the ends of the blank and force the ends inwardly closer together. Such motion effectively feeds more material to the die and permits greater elongation in the completed part with tighter corner radii. Motion limiting shoulders on the plugs assure that the feeding of material is even from both ends. Typical range of motion for a plug is about 0.5 inches.

10 Claims, 4 Drawing Sheets

SLIDING PLUG FOR APPLYING END LOADS DURING ISOSTATIC BULGE FORMING

REFERENCE TO RELATED APPLICATION

The present application claims the benefit of U.S. Provisional Patent Application Ser. No. 60/079,660, filed Mar. 27, 1998.

TECHNICAL FIELD

The present invention relates to isostatic bulge forming, and, more particularly, to an improvement using a sliding plug to apply a compressive load to the ends of the blank during the forming process.

BACKGROUND OF THE INVENTION

In U.S. Pat. No. 5,419,171, Bumgarner (Boeing) describes isostatic bulge forming of tube stock. Many metal ducts and tubes having irregular bends, bulges, or indentations are in commercial aircraft, for example, for air conditioning or heating ducts or engine bleed air systems. An environment requiring one of the most convoluted metal tubes is the duct that carries hot exhaust gases from the jet engines.

Ducts that are relatively straight and that do not have harsh or abrupt bulges or indentations are commonly shaped using conventional bulge forming methods, including hydroforming. U.S. Pat. 2,372,917 describes a conventional method of bulge forming a tube using a split female tool. A liquid is pressurized in the interior of the tube while pressure is vented from the tool cavities. German Patent 24 42 801 describes another bulge forming method featuring an intermediate fluid filled chamber to accomplish pressurization of the forming liquid. U.S. Pat. No. 3,564,886 shows another, similar bulge-forming method using a vented tool. Finally, U.S. Pat. Nos. 3,359,624 and 3,462,821 describe pipe forming using conventional bulge forming techniques. I incorporate all these patents by reference.

A conventional bulge forming apparatus consists of an upper platen and lower platen. A jig collar holds two, matching die halves together around the tube stock blank. The blank is formed to expand outwardly to conform with and to match the interior contour of the dies. The blank is held firmly with a bottom and top piston. An incompressible fluid is fed into the blank through an inlet in the bottom piston. Air is simultaneously evacuated through an outlet in the top piston. When all the air is gone, a valve on the outlet is closed and pressure is applied to the fluid causing the blank to bulge into the dies.

This conventional method has many limitations. It requires a high tonnage press and high strength machined tools that will withstand the application of hydraulic pressures up to 20,000 psi. While the method may be cost effective to make thousands of the same parts, it is expensive to provide a high tonnage press and such tooling for parts making only a few parts with short production runs. Moreover, the process is essentially limited to the manufacture of rather straight tubes of rather short length and small interior volume. In addition, it requires substantial scrap from the trimming of the blank above and below the bulge formed section of pipe.

Most part runs of large tubes and ducts make a small number of parts measured in the hundreds per year at current record production rates for commercial transport aircraft. Forming such tubes has commonly been done by hammer forming small segments and then welding the segments together. While tooling costs for this method are relatively low it is labor intensive and difficult to control quality.

In U.S. Pat. No. 5,419,171, an improved isostatic bulge forming method is described for forming a metal tube. The bulge forming apparatus uses a fluid pressure chamber having a valved inlet and a valved outlet for entry and egress of the forming fluid. The forming assembly has mated tool halves that were retained in a fixturing tube. When the tube stock blank was inserted in the tool, top and bottom annular caps of the assembly formed a fluid tight seal between the walls of the blank and the inside of the retaining tube.

To form the blank under isostatic conditions, the chamber was filled with fluid. The fluid surrounded the entire forming assembly. The fluid in the chamber was pressurized and the tube bulged into the compressible air spaces or evacuated volume between the blank and the configured inner surface of the die. Once the blank was formed, the pressure on the fluid was relieved, the assembly was removed from the chamber, and the part was removed from the assembly. I follow essentially the same steps in the present invention with essentially the same basic equipment. I use, however, sliding plugs in the present invention to apply end loads to the blank, and achieve better performance and increased versatility without significantly higher tooling costs.

Because equal forces are applied in the isostatic bulge forming process to both sides of the tools in the chamber, there is no need for high strength tooling. The isostatic nature of the pressure application to an unrestrained assembly allows considerable latitude for bent and contorted tube shapes, so isostatic bulge forming is particularly suited for aerospace manufacturing.

As U.S. Pat. No. 5,419,171 (Bumgarner) illustrates, sealing between the tube stock blank and the forming die (actually the retaining cylinder) occurs along the wall of the blank with o-ring seals on the annular tooling end caps. The ends of the blank are free from engagement with tooling and extend beyond the length of the die. In the present, invention, sliding or floating plugs that are able to slide within the forming die apply compressive end loads to the blank during forming. These sliding plugs make the process more versatile. The improved bulge forming process of the present invention allows greater elongation of the blank than Bumgarner achieved because the end loading effectively feeds material in the blank to the die cavity during forming. Elongation can nearly be doubled. The specifications for corner radii can be set tighter.

U.S. Pat. No. 4,840,053 (Nakamura) describes a bulge forming method for manufacturing a pipe with projections, such as a manifold for automobiles. Bulges can be formed in sequential stages to assure adequate thickness in each branch pipe. Bulge spaces are filled with movably mounted spaces to facilitate the sequential forming. Holders at each end of the pipe are pressed axially inwardly to exert the bulging force on the pipe. In the present invention, sliding plugs are 'self feeding' and move inwardly to compensate for the expansion during forming, thereby eliminating the need for hydraulic cylinders to press Nakamura 's holders inwardly.

SUMMARY OF THE INVENTION

To increase the achievable elongation of tube stock blanks and to avoid multiple forming operations with intermediate cleaning and annealing steps, my improved isostatic bulge forming process uses sliding end load plugs. The process eliminates processing steps, improves cycle time, reduces material scrap rates, and increases the capabilities of the basic bulge forming process (allows more complicated parts to be formed). The process of the present invention is an improvement to the process described in U.S. Pat. No. 5,419,171, which I incorporate by reference. The sealing end caps that interconnect the tube stock blank and the mated bulge forming dies includes O-ring seals as in the earlier apparatus. The sliding plugs, however, seat between the dies at the ends of the tube stock blank rather than in the annulus between the blank and the retaining cylinder of the die.

As bulge forming begins and the blank begins to elongate into the die from the internal fluid pressure, the pressure inside the blank falls and the sliding plugs are drawn into the die to apply a compressive end load on the tube stock blank. This compressive load effectively and automatically without a separate press feeds more material to the die by pushing ends of the tube stock blank closer together. Motion occurs automatically and naturally as expansion progresses because of the decrease in pressure inside the blank as it elongates into the bulge defining cavities in the mold. Motion limiting shoulders on the sliding plugs assure that material is fed evenly. Typically, one side will bottom out (reach its limit) first. Then the material will feed from the other end of the die. Typical movement is about 0.5 inches per plug.

Sliding plugs allow nearly a doubling of the achievable elongation, which makes the process much more versatile. The method using sliding plugs can make tighter corner radii.

The present invention relates to the method for isostatic bulge forming using sliding plugs to apply end load to the tube stock blank. It also relates to the isostatic bulge forming apparatus and to the individual plugs that allow such end loading of the tube stock blank. Finally, the present invention relates to parts made using the process and apparatus.

DETAILED DESCRIPTION OF A PREFERRED EMBODIMENT

Sliding plugs use o-ring seals against the internal walls of an isostatic bulge forming die to apply end load to tube stock blanks during isostatic bulge forming. The die is made from two or more mating segments that assemble together to define a central channel for holding the tube stock blank. The plugs move inwardly into the die when the blank elongates or expands into the die, because such expansion reduces the internal pressure within the blank. The plugs are drawn inwardly because of the pressure decline in the blank. The plugs compress the ends of the blank and force the ends inwardly closer together. Such motion effectively feeds more material to the die and permits greater elongation in the completed part with tighter corner radii. The present invention is an improvement to the process and apparatus described in U.S. Pat. No. 5,419,171 through a tooling modification. Motion limit shoulders on the plugs assure that the feeding of material is even from both ends. Typical range of motion for a plug is about 0.5 inches.

The present invention consists of: 1) the tooling for applying the end load; and 2) the process of applying an end load to the blank in the isostatic press.

Figure 6:
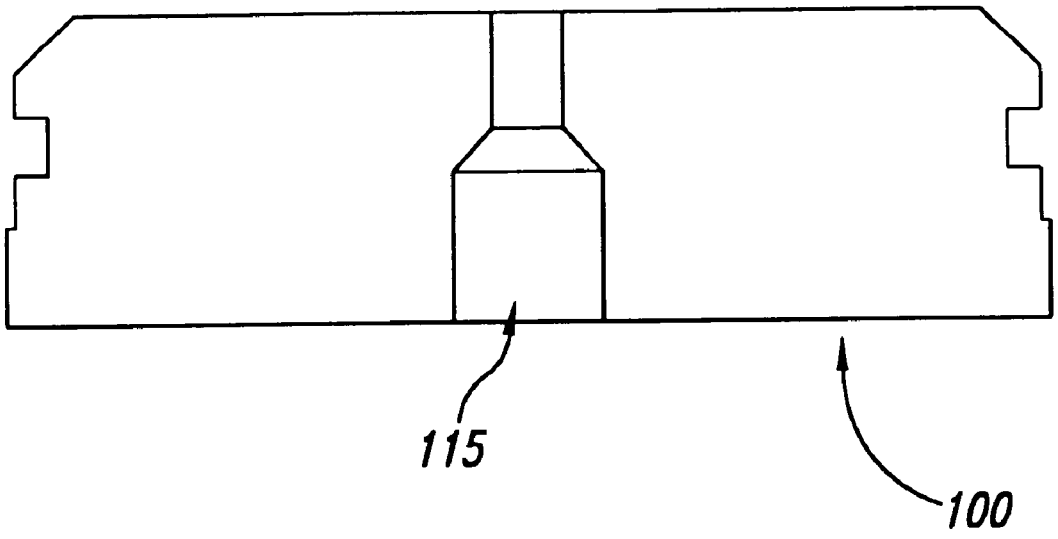
FIG. 6 is a detailed cross section of a typical sliding plug of the present invention.

The preferred tooling consists of a pair of steel plugs 100 that have rubber O-rings 105 received in appropriate grooves for fluid sealing purposes. The plugs are sized to fit inside the tube stock blank 30 with about 0.005 inch clearance per side. The plugs have a step out to a larger diameter that substantially matches the outside diameter of the tube stock blank. A machined threaded hole 115 (FIG. 6) passes through the center of each plug for insertion of a standard pipe threaded plug. The threaded plug allows for pressurized fluid to enter the inside of the blank. The tooling works with many existing isostatic forming dies.

The process for forming the blanks preferably proceeds as follows:

- the o-ring plugs are put in the ends of the blank;
- the die halves are bolted together;
- the assembled die is lowered into the fluid in the isostatic press pressure vessel;
- forming fluid from the pressure vessel is allowed to flow into the blank through the threaded port on the upper plug;
- the threaded pipe plug is put in place in the upper o-ring plug to seal the inside of the blank to form a lid;
- the lid is placed in the pressure chamber;
- the chamber is shuttled into a static framework;
- the pressure chamber is pressurized up to a maximum of about 15,000 psi, as typically used for isostatic bulge forming to form the blank;
- the threaded pipe plugs are removed and fluid in the die drains;
- the die is disassembled and the plugs are removed from the ends; and
- the formed blank is ready for subsequent processing.

As the pressure in the isostatic bulge forming assembly increases, pressure builds against the o-ring plugs. The o-ring plugs in turn push on the fluid inside the blank. Since the water is incompressible, pressure builds without movement of the plugs until the blank reaches its yield point and begins to stretch and to form into the die. As the blank begins to form, the pressure drops inside the blank. To compensate for the pressure differential, the o-ring plugs move inward, exerting force on the ends of the blank. This force provides a compressive end load on the blank, and effectively feeds material automatically into the die cavity. Longer elongation is possible because of the feeding of material.

Figure 1:
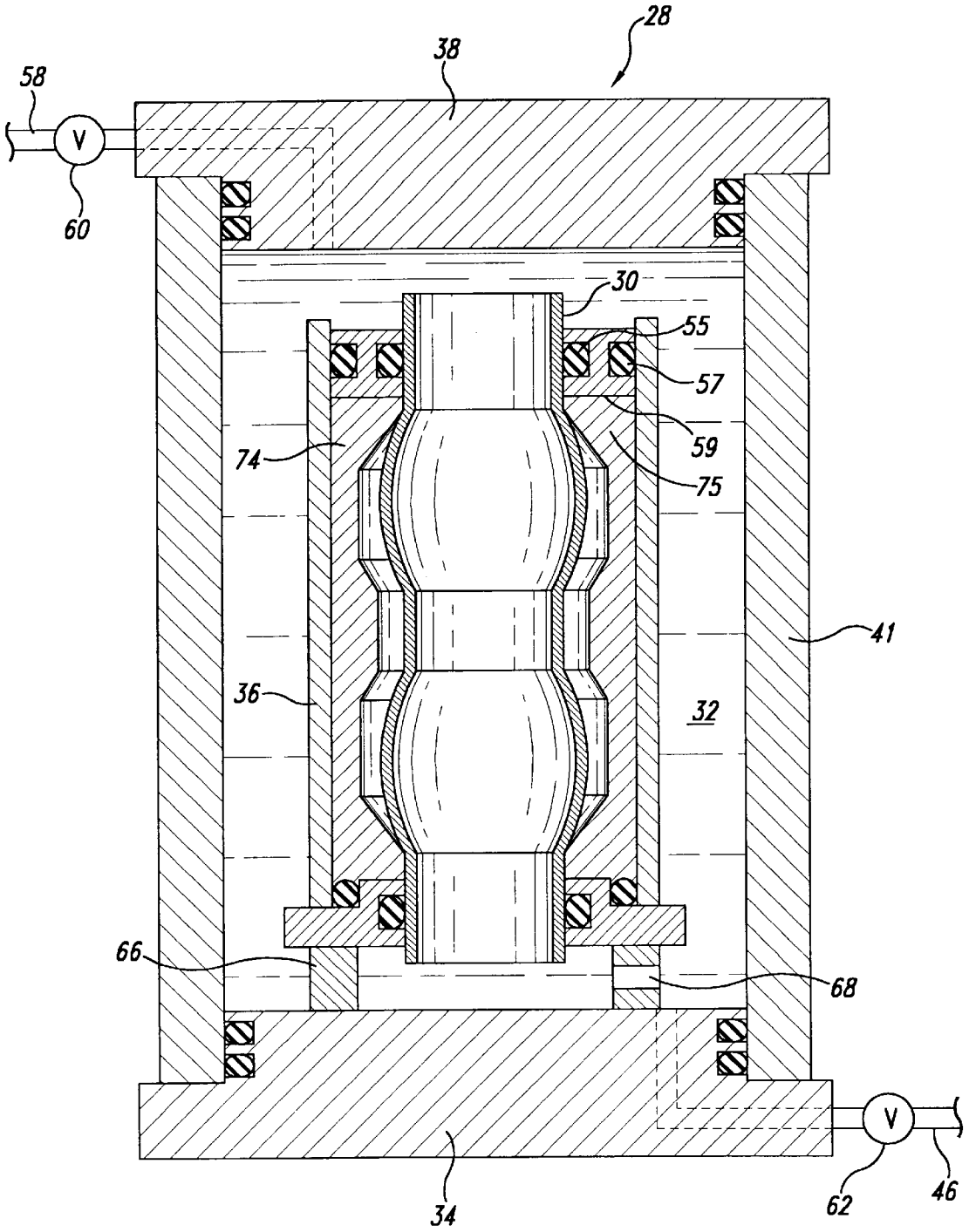
FIG. 1 is a cross sectional view of a Bumgarner isostatic bulge forming assembly.

An isostatic bulge forming apparatus is shown in FIG. 1. Top cap 38 has a shoulder that overhangs the top edge of retaining cylinder 41 that seats on a bottom plate 34 to define the pressure chamber 28. The top cap, cylinder, and bottom plate should be able to withstand pressures of at least about 15,000 psi O-rings 55 and 57 in an annular sealing ring 59 seat in appropriate grooves and form fluid and air-tight seals between the blank 30 and a retaining cylinder 36 that supports the forming die segments 74 and 75. Line 58 runs through top cap 38. Valve 60 controls flow of pressurized fluid through line 58. Assembly 28 is confined in a frame or press (not shown) which prevents unseating of top cap 3 8 when fluid 62 is introduced into chamber 32 at pressure sufficient to accomplish isostatic bulge forming. The top cap 38 is readily removable to allow assembly 28 to be easily shuttled into a fixed height frame. When fluid is forced into chamber 32, top cap 38 is pushed up to meet the restraining frame allowing no further movement even when high pressure is created within chamber 32.

To perform the isostatic bulge forming method, chamber 32 is filled with an incompressible fluid, such as water or oil, through line 46 in the bottom plate. Air is vented through line 58. Valves 60 and 62 are closed when chamber 32 is filled. The fluid in the chamber is pressurized by means of a suitable pump to a pressure sufficient to push against the inside of blank 30, commonly a titanium tube in aerospace applications. The fluid surrounds the die and accesses the bottom of the blank 30 through channels 68 fashioned into standoff 66 that support the lower end of the die assembly. The pressure forces the blank outwardly in a bulge into forming space between the outside of the blank and the inside of the die 74 and 75. Air in the forming space is compressed, or is vented into chamber 32, or is forced into a retaining cavity (not shown). If desired, forming space 82 may be evacuated before chamber 32 is pressurized. The small amount of residual air pressure in the die is generally not enough to cause any springback of a formed tube.

In a preferred practice of the invention, the pressure vessel in which the isostatic bulge forming takes place is comprised of a thick walled pipe. For example, a pressure vessel may be machined from a cast iron pipe. A typical vessel pipe size for forming stainless steel aircraft exhaust tubes is a 4 inches thick, 28 inches long and has an inside diameter of 18 inches. The end caps may be machined from steel, and 90 durometer urethane O-rings have been found to form adequate seals. Generally, forming pressures in the range of about 10,000–15,000 psi have been found adequate to form stainless steel exhaust tube stock or titanium tube stock. Other higher or lower pressures would be suitable to form other materials. Tube stock thickness will also influence the amount a pressure needed to isostatically bulge form a workpiece.

Significant advantages of the present invention over prior art bulge forming include the features that the forming can take place at room temperature and that the tooling is relatively inexpensive. Conventional practices require tools that can withstand forming pressures of 10,000 to 20,000 psi in one direction. Such tooling usually must be machined from high strength tool steels. They are difficult to manufacture and are expensive.

The dies for the present invention, however, have adequate compressive strengths when cast, in some applications, from polymeric or metallic materials around forms or existing parts. For example, nylon and kirksite could be used as die materials in some applications. Tooling fixtures also need not be made from high tensile strength materials. For example, aluminum retaining rings and end caps have been found to be acceptable. The method is particularly useful for consistently and inexpensively producing short runs of high quality parts. Typically the dies are machined from aluminum, and the plugs are steel. These features save manufacturing time for making the tools and greatly reduce their cost. Both features are important in aircraft part production where tooling costs need to be minimized.

Figure 2:
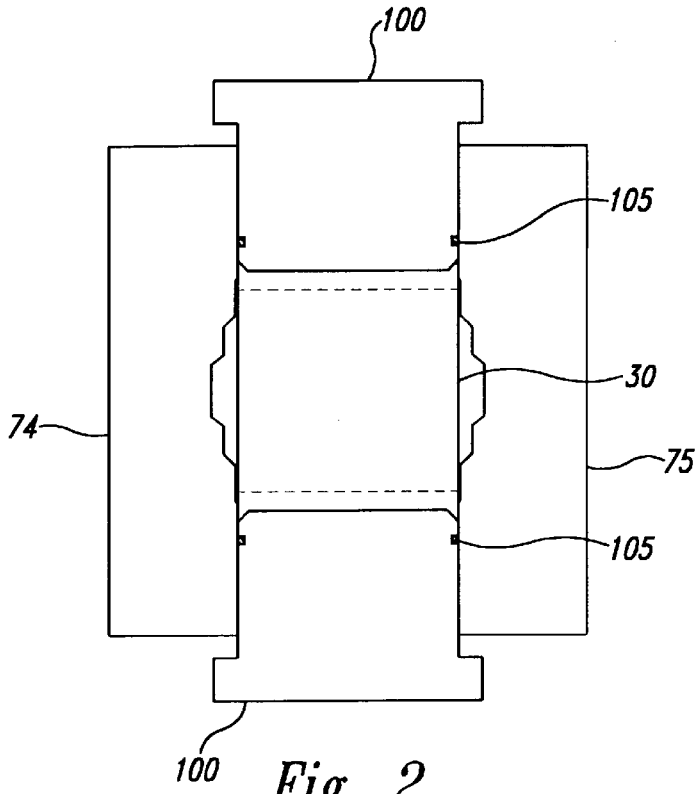
FIG. 2 is a cross sectional view of the sliding plug assembly of the present invention prior to forming. The surrounding chamber is omitted for clarity of illustration, but it is generally the same as the chamber used in U.S. Pat. No. 5,419,171.
Figure 3:
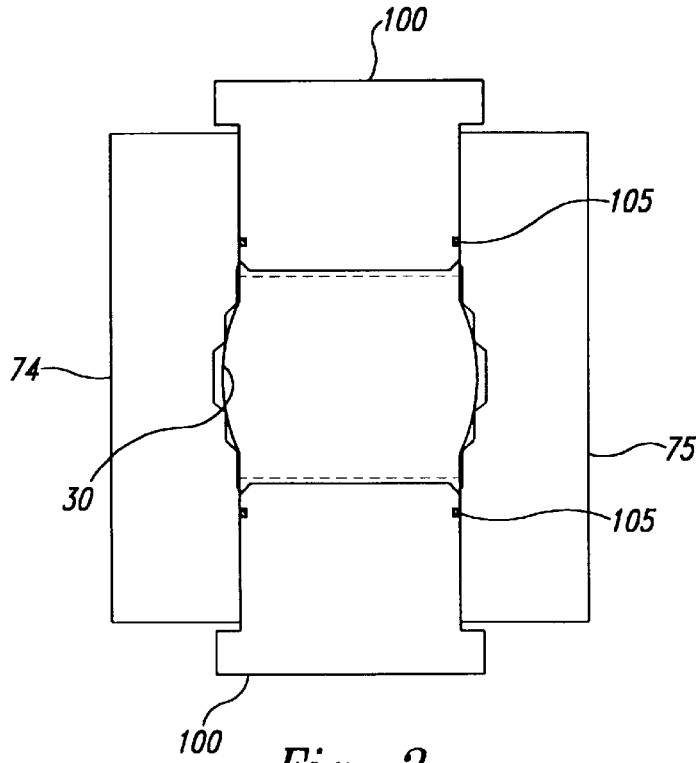
FIG. 3 is another cross sectional view of the assembly of FIG. 2 showing partial forming of the tube.
Figure 4:
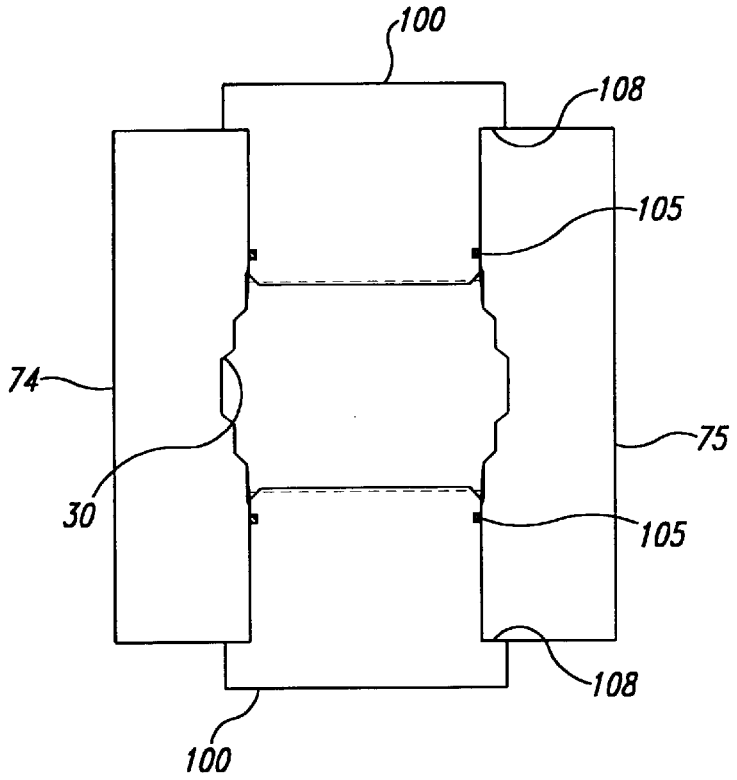
FIG. 4 is yet another cross sectional view of the assembly of FIG. 2 or FIG. 3 showing complete forming of the tube with shoulders on the sliding plugs abutting the bulge forming die.
Figure 5:
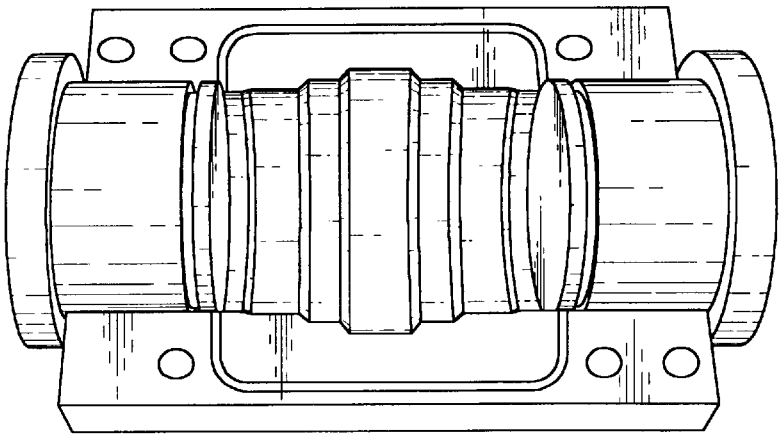
FIG. 5 is an assembly showing two, sliding end load plugs of the present invention positioned in an isostatic bulge forming die half

FIGS. 2, 3, and 4 illustrate the operation of the sliding plugs 100. They initially are seated to abut the ends of the blank 30 (FIG. 2). As forming begins (FIG. 3), they slide inwardly as the pressure inside the blank declines. Shoulders 108 limit the inward motion when they engage the die segments 74 and 75. The shoulders ensure that substantially even forming occurs from each end of the blank. Without the shoulders, the forming would not likely occur evenly.

While I have described preferred embodiments, those skilled in the art will readily recognize alterations, variations, and modifications that might be made without departing form the inventive concept. Therefore, interpret the claims liberally with the support of the full range of equivalents known to those of ordinary skill based upon this description. The examples are given to illustrate the invention and not intended to limit it. Accordingly, limit the claims only as necessary in view of the pertinent prior art.

I claim:

1. A method for isostatic bulge forming, comprising the step of:

applying an end load to a tube stock blank while forming the blank hydrostatically in a static die with pressurized fluid within the blank using isostatic bulge forming, the end load compressing ends of the blank inwardly to feed material in the blank automatically to the die to allow greater elongation, tighter corner radii, or both.

2. The method of claim 1 wherein the load is applied with sliding plugs sealingly engaging a bulge forming die that holds the blank, the plugs sliding inward automatically when the blank forms.

3. The method of claim 2 further comprising the step of:

limiting inward motion of a sliding plug to assure substantially even feed of material in the blank.

4. The method of claim 3 wherein the plug includes a motion limiting shoulder that contacts the die to stop motion.

5. A bulge forming assembly tool, comprising:

(a) matching bulge forming die halves mated to form a stationary die adapted to surround a tube stock blank, the halves including an internal channel configured to correspond with the bulge formed duct and ends projecting beyond the ends of the blank, and (b) at least one sliding plug sealingly engagable with the interior of the blank within the channel of the mated die halves, the plug including a face for engaging an end of the tube stock blank and a motion limiting shoulder for contacting the die halves to stop inward movement of the plug, the plug moving inward when the blank yields from pressure exerted on the blank with fluid injected through a port in the plug, wherein such inward movement of the plug causes the face to apply a compressive end load to the blank to feed the blank into the die.

6. The tool of claim 5 comprising two sliding plugs, one plug for each end, wherein sliding occurs substantially equally from each end and each plug includes a port for the fluid.

7. The tool of claim 6 wherein the die halves are cast and the plugs are steel.

8. A sliding plug for isostatic bulge forming to apply a compressive end load to a tube stock blank during forming, comprising:

(a) a solid body adapted for sealingly engaging the interior of the blank when the blank is seated in an internal channel at one end of a complimentary bulge forming die;

(b) a face on the plug for engaging an end of the blank and for applying an inward compressive load to the blank during isostatic bulge forming of the blank;

(c) a channel through the body and the face for fluid communication with a cavity inside the blank to permit application of fluid pressure through the body into the cavity sufficient to bulge form the blank, and (d) optionally, a motion limiting shoulder to stop inward motion of the body during bulge forming by the shoulder engaging the bulge forming die.

9. A method for isostatic bulge forming of a tube stock blank, comprising the steps of:

(a) assembling a bulge forming die around the blank, the die having an internal configuration corresponding to the bulged configuration of the formed tube, the die extending beyond both ends of the blank;

(b) sealingly engaging sliding plugs on the interior of the blank in each end of the die, the plug having a face engaging an end of the blank and a channel for allowing fluid communication into the inside of the blank suitable for introducing a forming fluid;

(c) bulge forming the blank by introducing isostatic pressure with a fluid within the inside of the blank through the channels in the plugs;

(d) sliding the plugs inwardly automatically to apply an inwardly compressive end load to the blank when the blank begins to form; and (e) optionally, limiting motion of the plugs inwardly with a limiting shoulder.

10. The method of claim 9 wherein the die is cast and the plugs are steel.

* * * * *